US007545393B2

(12) United States Patent
Kanai

(10) Patent No.: US 7,545,393 B2
(45) Date of Patent: Jun. 9, 2009

(54) DISPLAY DEVICE, METHOD OF MANUFACTURING DISPLAY DEVICE, INFORMATION PROCESSING APPARATUS, CORRECTION VALUE DETERMINING METHOD, AND CORRECTION VALUE DETERMINING DEVICE

(75) Inventor: Izumi Kanai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 531 days.

(21) Appl. No.: 10/890,192

(22) Filed: Jul. 14, 2004

(65) Prior Publication Data

US 2005/0012821 A1 Jan. 20, 2005

(30) Foreign Application Priority Data

Jul. 15, 2003 (JP) ..... 2003-274993
Jul. 2, 2004 (JP) ..... 2004-196394

(51) Int. Cl.
*G09G 5/10* (2006.01)

(52) U.S. Cl. ..... 345/690

(58) Field of Classification Search ..... 345/189, 345/55, 75.2, 63, 75, 690
See application file for complete search history.

(56) References Cited

U.S. PATENT DOCUMENTS 6,628,255 B1 * 9/2003 Ferrel et al. ..... 345/88
6,760,001 B2 7/2004 Kanda et al. ..... 345/74.1
6,873,711 B1 * 3/2005 Murakami et al. ..... 382/100
6,882,328 B2 * 4/2005 Araki ..... 345/60
2002/0036715 A1 * 3/2002 Honda et al. ..... 348/672
2002/0081029 A1 6/2002 Marugame
2002/0122018 A1 9/2002 Kanda et al. ..... 345/75.2
2002/0171608 A1 11/2002 Kanai et al. ..... 345/55
2003/0081136 A1 * 5/2003 Kobayashi ..... 348/333.1
2003/0122743 A1 * 7/2003 Suzuki ..... 345/63

FOREIGN PATENT DOCUMENTS

JP 2000-122598 4/2000
JP 2003-123650 4/2003
WO WO 94/28508 12/1994
WO WO 01/67391 A2 9/2001
WO WO 03/002957 A2 1/2003
WO WO 03/015066 A2 2/2003
WO WO 03/091976 A1 11/2003

* cited by examiner

*Primary Examiner*—Richard Hjerpe
*Assistant Examiner*—Shaheda A Abdin
(74) *Attorney, Agent, or Firm*—Fitzpatrick, Cella, Harper & Scinto

(57) ABSTRACT

A display device includes a plurality of display elements and a correction circuit which outputs signals obtained by performing correction on input signals to the respective display elements, and the correction circuit performs the correction so that a spatial frequency distribution of luminance obtained by driving the respective display elements by using the signals obtained by performing the correction on the input signals indicative of predetermined luminance becomes a spatial frequency distribution in which a predetermined frequency component is reduced from among frequency components contained in a spatial frequency distribution of luminance obtained by driving the respective display elements without performing the correction on the input signals indicative of the predetermined luminance and at least a portion of frequency components lower than the predetermined frequency component is left.

4 Claims, 14 Drawing Sheets

Fig.3

| | | | | | | |
|---|---|---|---|---|---|---|
| 99 | 97 | 93 | 96 | 108 | 111 | 107 |
| 89 | 96 | 91 | 101 | 111 | 95 | 105 |
| 90 | 101 | 96 | 107 | 108 | 99 | 104 |
| 103 | 98 | 101 | 100 | 111 | 112 | 109 |
| 97 | 105 | 104 | 104 | 110 | 102 | 101 |
| 103 | 108 | 95 | 108 | 92 | 106 | 113 |
| 103 | 99 | 90 | 104 | 103 | 103 | 94 |

Fig.5

| | | | | | | |
|---|---|---|---|---|---|---|
| 99 | 99 | 99 | 99 | 100 | 100 | 100 |
| 99 | 99 | 99 | 99 | 100 | 100 | 100 |
| 99 | 99 | 99 | 99 | 100 | 100 | 100 |
| 99 | 99 | 99 | 99 | 100 | 100 | 100 |
| 99 | 99 | 99 | 99 | 100 | 100 | 100 |
| 99 | 99 | 99 | 99 | 100 | 100 | 100 |
| 99 | 99 | 99 | 99 | 100 | 100 | 100 |

Fig.7

| | | | | | | |
|---|---|---|---|---|---|---|
| 1 | 1.02 | 1.06 | 1.03 | 0.93 | 0.9 | 0.93 |
| 1.11 | 1.03 | 1.09 | 0.98 | 0.9 | 1.05 | 0.95 |
| 1.1 | 0.98 | 1.03 | 0.93 | 0.93 | 1.01 | 0.96 |
| 0.96 | 1.01 | 0.98 | 0.99 | 0.9 | 0.89 | 0.92 |
| 1.02 | 0.94 | 0.95 | 0.95 | 0.91 | 0.98 | 0.99 |
| 0.96 | 0.92 | 1.04 | 0.92 | 1.09 | 0.94 | 0.88 |
| 0.96 | 1 | 1.1 | 0.95 | 0.97 | 0.97 | 1.06 |

Fig.10

| | | | | | | |
|---|---|---|---|---|---|---|
| 100 | 100 | 100 | 100 | 100 | 100 | 100 |
| 100 | 100 | 100 | 100 | 100 | 100 | 100 |
| 100 | 100 | 100 | 100 | 100 | 100 | 100 |
| 100 | 100 | 100 | 100 | 100 | 100 | 100 |
| 100 | 100 | 100 | 100 | 100 | 100 | 100 |
| 100 | 100 | 100 | 100 | 100 | 100 | 100 |
| 100 | 100 | 100 | 100 | 100 | 100 | 100 |

Fig.11

| | | | | | | |
|---|---|---|---|---|---|---|
| 1.01 | 1.03 | 1.08 | 1.04 | 0.93 | 0.9 | 0.93 |
| 1.12 | 1.04 | 1.1 | 0.99 | 0.9 | 1.05 | 0.95 |
| 1.11 | 0.99 | 1.04 | 0.93 | 0.93 | 1.01 | 0.96 |
| 0.97 | 1.02 | 0.99 | 1 | 0.9 | 0.89 | 0.92 |
| 1.03 | 0.95 | 0.96 | 0.96 | 0.91 | 0.98 | 0.99 |
| 0.97 | 0.93 | 1.05 | 0.93 | 1.09 | 0.94 | 0.88 |
| 0.97 | 1.01 | 1.11 | 0.96 | 0.97 | 0.97 | 1.06 |

DISPLAY DEVICE, METHOD OF MANUFACTURING DISPLAY DEVICE, INFORMATION PROCESSING APPARATUS, CORRECTION VALUE DETERMINING METHOD, AND CORRECTION VALUE DETERMINING DEVICE

This application claims priority from Japanese Patent Application No.2003-274993 filed Jul. 15, 2003 and No.2004-196394 filed Jul. 2, 2004, which are hereby incorporated by reference.

BACKGROUND OF THE INVENTION

1. Field of the Invention

The present invention relates to a display device having a plurality of display elements, and more particularly, to a method of correcting luminance unevenness of the display device.

2. Description of the Related Art

Individual display elements such as electron emitting devices have small differences in their element characteristics produced in a manufacturing process or the like. Accordingly, if a display device is produced by using such display elements, there is the problem that these differences in characteristic appear as luminance unevenness.

A method of correcting this luminance unevenness by correcting a driving signal has heretofore been proposed. Specifically, JP-A-2000-122598 discloses a construction which performs correction in the luminance unevenness of a display element on an initial change and a temporal change.

In the existing method of correcting a driving signal, a correction value is set so that a luminance target value (in this specification, luminance obtained by ideal correction is called a luminance target value) becomes uniform.

However, there occurs the problem that if the luminance target value is made uniform, a correction amount becomes large.

SUMMARY OF THE INVENTION

Accordingly, the invention has been made to solve the above-described problem of the related art, and realizes a construction capable of providing suitable display while restraining a correction amount.

Therefore, the invention provides a display device which includes a plurality of display elements and a correction circuit which outputs signals obtained by performing correction on input signals to the respective display elements. The correction circuit performs the correction so that a spatial frequency distribution of luminance obtained by driving the respective display elements by using the signals obtained by performing the correction on the input signals indicative of predetermined luminance becomes a spatial frequency distribution in which a predetermined frequency component is reduced (there is also a case where the predetermined frequency component is omitted) from among frequency components contained in a spatial frequency distribution of luminance obtained by driving the respective display elements without performing the correction on the input signals indicative of the predetermined luminance and at least a portion of frequency components lower than the predetermined frequency component is left.

The invention provides a display device which includes a plurality of display elements and a correction circuit which outputs signals obtained by performing correction on input signals to the respective display elements. A spatial frequency distribution of luminance obtained by driving the respective display elements by using the signals obtained by performing the correction on the input signals indicative of predetermined luminance is a spatial frequency distribution in which at least some frequency components are reduced from among frequency components contained in a spatial frequency distribution of luminance obtained by driving the respective display elements without performing the correction on the input signals indicative of the predetermined luminance. The spatial frequency distribution of luminance obtained by driving the respective display elements by using the signals obtained by performing the correction on the input signals indicative of the predetermined luminance contains a predetermined frequency component which is not a 0. The spatial frequency distribution of luminance obtained by driving the respective display elements by using the signals obtained by performing the correction on the input signals indicative of the predetermined luminance has, on a higher-frequency side than the predetermined frequency component, a frequency component which is reduced by the correction in an amount greater than the predetermined frequency component.

The frequency component which is reduced by the correction in an amount greater than the predetermined frequency component also includes a component in which the frequency component is set to a 0 by the correction.

The invention also provides an information processing apparatus which includes the above-described display device and a receiving device which receives information to be displayed on the display device.

The invention also provides a method of determining correction values to correct driving data for driving a plurality of display elements for displaying an image. The method includes a step of acquiring data having a correlation to luminance by driving a display element in accordance with image data for measuring, a step of performing conversion of the data having the correlation to the acquired luminance into spatial frequency data, a step of reducing a predetermined high-frequency component while leaving at least a predetermined low-frequency component from among the spatial frequency data, and calculating a spatial frequency component of a luminance target value, a step of acquiring a luminance target value by performing the inverse conversion of the conversion on the spatial frequency data on the luminance target value, and a step of calculating a correction value for driving data for driving the display element, on the basis of the luminance target value.

The step of calculating the spatial frequency of the luminance target value suitable includes a step of comparing a frequency component of the spatial frequency data with a spatial frequency component of a luminance unevenness discrimination threshold and selecting the smaller value as the spatial frequency component of the luminance target value. The step of calculating the correction value suitably includes a step of dividing the luminance target value by the acquired data having the correlation to luminance.

The step of calculating the spatial frequency of the luminance target value suitably includes a step of reducing a predetermined low-frequency component from among frequency components of the spatial frequency data, setting a frequency component except the predetermined low-frequency component to a 0, and selecting the frequency component as the spatial frequency component of the luminance target value, and the step of calculating the correction value suitably includes a step of dividing the luminance target value by the acquired data having the correlation to luminance.

The invention also provides a correction value determining device for correcting driving data for driving a plurality of display elements. The correction value determining device includes index data acquiring means for acquiring data having a correlation to luminance by driving a display element in accordance with image data for measuring, an index data conversion circuit for performing conversion of the acquired data having the correlation to luminance into spatial frequency data, a luminance target value spatial frequency component computing circuit for reducing a predetermined high-frequency component while leaving at least a predetermined low-frequency component from among the spatial frequency data, and calculating a spatial frequency component of a luminance target value, a spatial frequency component inverse conversion circuit for performing the inverse conversion of the conversion on the spatial frequency data on the luminance target value, and a correction value calculation circuit for calculating a correction value for driving data for driving the display element, on the basis of the luminance target value obtained by the spatial frequency component inverse conversion circuit.

The luminance target value spatial frequency component computing circuit suitably has a function for comparing a frequency component of the spatial frequency data with a spatial frequency component of a luminance unevenness discrimination threshold and selecting the smaller value as the spatial frequency component of the luminance target value, and the correction value calculation circuit suitably has a function for dividing the luminance target value obtained by the spatial frequency component inverse conversion circuit by the acquired data having the correlation to luminance, and calculating the correction value.

The luminance target value spatial frequency component computing circuit suitably has a function for reducing a predetermined frequency component from among frequency components of the spatial frequency data, setting a frequency component except the predetermined frequency component to a 0, and selecting the frequency component as the spatial frequency component of the luminance target value. The correction value calculation circuit suitably has a function for calculating the correction value by dividing the luminance target value obtained by the spatial frequency component inverse conversion circuit by the acquired data having the correlation to luminance, and calculating the correction value.

According to the invention, it is possible to reduce a correction amount by leaving some frequency components from among frequency components of luminance unevenness. It is also possible to realize a construction which does not easily allow luminance unevenness to be visible in spite of the reduced correction amount, particularly by leaving (maintaining or reducing) at least a portion of frequency components lower than a predetermined frequency component when the predetermined frequency component is deleted from the frequency components of the luminance unevenness. In addition, it is possible to realize a construction which restrains a correction amount by leaving (maintaining or reducing), without completely deleting, a predetermined frequency component from among frequency components of luminance unevenness, as well as which does not easily allow the luminance unevenness to be visible, by more greatly reducing frequency components higher than the predetermined frequency component.

Namely, it is possible to realize a construction which does not easily allow luminance unevenness to be visible in spite of a reduced correction amount, by adopting a construction which reduces or deletes some frequency components from among frequency components of luminance unevenness, and by selecting, as the frequency components to be reduced or deleted, frequency components of higher frequency than at least one of frequency components to be maintained without being reduced or to be maintained while being reduced. Namely, it is preferable to select at least components of higher frequency than a predetermined frequency as the frequency components to be reduced or deleted.

The luminance unevenness mentioned herein can be measured by driving individual display elements on the basis of input signals (signals having the same value) indicative of predetermined luminance. The spatial distribution of luminance obtained when no correction is performed can be obtained by a plurality of display elements being respectively driven by signals having the same value, whereas the spatial distribution of luminance obtained when a correction is performed can be obtained by the respective display elements being driven by signals obtained by correcting the signals having the same value.

BRIEF DESCRIPTION OF THE DRAWINGS

FIG. 3 is a view showing a luminance distribution obtained when no correction is performed;

FIG. 5 is a view showing luminance target values;

FIG. 7 is a view representing correction values;

FIG. 10 is a view showing luminance target values;

FIG. 11 is a graph representing correction values;

DETAILED DESCRIPTION OF THE PREFERRED EMBODIMENTS

Figure 1A:
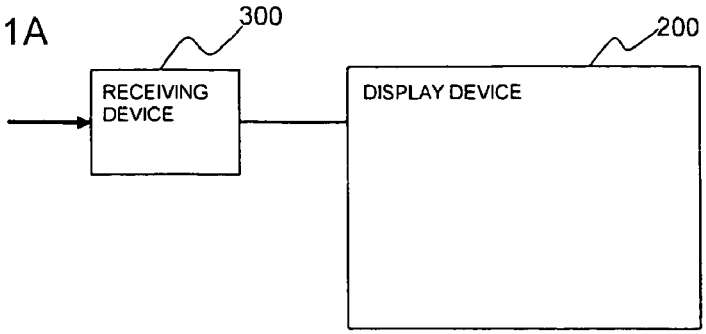
FIGS. 1A and 1B are circuit block diagrams of an embodiment.

FIG. 1A is a block diagram showing an information processing apparatus according to the invention. The information processing apparatus includes a display device 200 and a receiving device 300 which receives information to be displayed on the display device 200.

The receiving device 300 may use appropriate devices such as a television tuner which receives broadcast signals such as ground waves and satellite waves, a set top box (STB) used in cable television, and an interface device which receives communication signals via a network. The receiving device 300 and the display device 200 may be respectively accommodated in different cases, or they may also be accommodated in the same case.

Figure 1B:
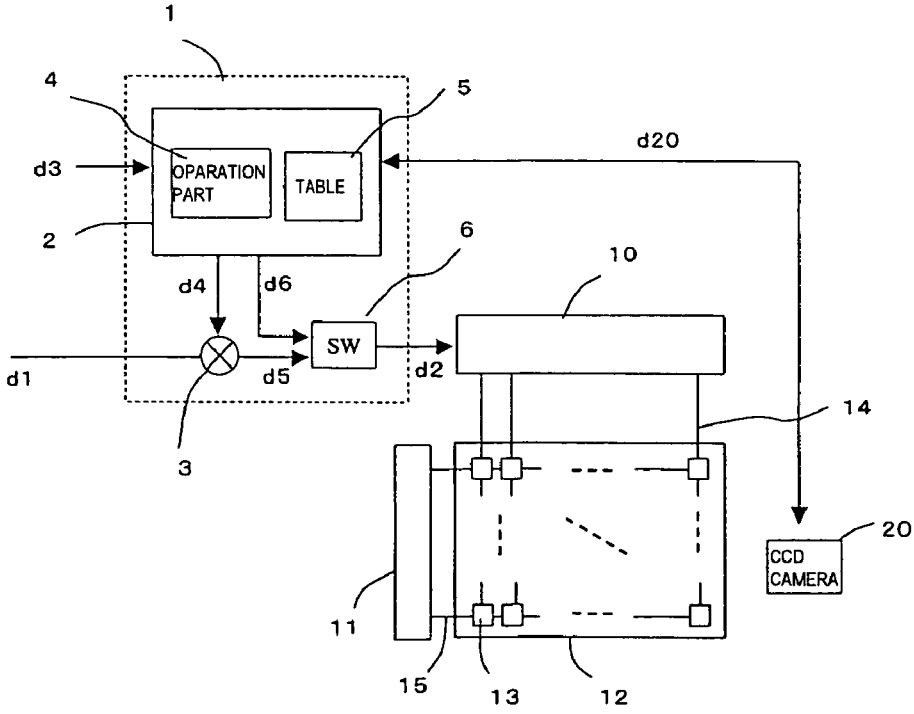

FIG. 1B is an explanatory view including circuit blocks of a correction value determining device according to the invention. Reference numeral 1 denotes a correction circuit, reference numeral 2 denotes a correction value generating part, reference numeral 3 denotes a multiplier, reference numeral 4 denotes an operation part, and reference numeral 5 denotes a table which stores correction values (storage means; specifically, a memory can be used. As the memory, a semiconductor memory can be suitably adopted, and a memory using a storage medium which stores magnetic information can also be used.) Reference numeral 6 denotes a switch, reference numeral 10 denotes a modulation circuit, reference numeral 11 denotes a scanning signal generating circuit, reference numeral 12 denotes a display panel, reference numeral 13 denotes a display element, reference numeral 14 denotes a vertical wiring, reference numeral 15 denotes a horizontal wiring, and reference numeral 20 denotes an unevenness measuring part. The display device 200 according to the invention includes the correction circuit 1, the correction value generating part 2, the multiplier 3, the operation part 4, the table 5, the switch 6, the modulation circuit 10, the scanning signal generating circuit 11, the display panel 12, the display elements 13, the vertical wirings 14, and the horizontal wirings 15.

(Flow of Signals)

A broadcast wave such as a television signal is decoded by a decoder which is not shown, and is converted into digital RGB signals after having been subjected to processing such as Y-C separation. A PC signal, if it is an analog signal, is converted into digital RGB signals after having been subjected to AD conversion and the like. In FIG. 1B, image data d1 denotes these digital RGB signals. Specifically, a signal outputted from the receiving device 300 shown in FIG. 1A is inputted to the multiplier 3 as the image data d1. As the image data d1, not only the digital RGB signals but also various signals can be inputted. For example, in the case where the receiving device 300 which receives a luminance signal and color-difference signals is used, a luminance signal and color-difference signals may also be inputted to the correction circuit 1 from the receiving device 300. However, since the RGB signals are suitable as the input to the correction circuit 1, if the receiving device 300 is a device which receives signals other than the RGB signals, the receiving device 300 preferably has a circuit which converts its received signal into the RGB signals.

The image data d1 is inputted to the correction circuit 1. The correction circuit 1 includes the correction value generating part 2 having the operation part 4 and the table 5, the multiplier 3 which multiplies a correction value d4 outputted from the correction value generating part 2 by the image data d1, and the switch 6 which effects switching between measuring data d6 outputted from the correction value generating part 2 and an output d5 of the multiplier 3.

Image data d2 outputted from the correction circuit 1 is inputted to the modulation circuit 10, and the modulation circuit 10 performs predetermined modulation on the image data d2. After that, the image data d2 is outputted to the display elements 13 through a driving circuit as driving signals, and is displayed on the display elements 13 as an image.

(Display Panel)

The display panel 12 will be described below. The display panel 12 has a construction in which the display elements 13 are arranged in matrix form. One display element corresponds to any one color of R, G and B that constitutes one pixel.

This embodiment adopts a display element of the type which performs electron emission through the application of a voltage to an electron emitting device and causes a phosphor corresponding to the electron emitting device to emit light, but other types of display elements which emit light by voltage application, such as organic EL elements and plasma emission elements, may also be adopted.

In this embodiment, the display panel 12 has a resolution of WXGA (1,280×768). In this case, 1,280×3 (RGB)×768≅three million display elements are arranged as the display elements 13.

These display elements 13 are respectively connected to the intersections of the vertical wirings 14 and the horizontal wirings 15 which are arranged in matrix form. The vertical wirings 14 are connected to the modulation circuit 10, while the horizontal wirings 15 are connected to the scanning signal generating circuit 11.

In this embodiment, the driving method of the display panel 12 is passive matrix line sequential driving. First, a certain row of the display panel 12 is selected during one horizontal scanning period of video. A scanning signal is applied to the selected row from the scanning signal generating circuit 11 through the corresponding one of the horizontal wirings 15. In this manner, the scanning signal is applied to the display elements connected to the selected row, i.e., 1,280×3 (RGB) display elements.

In the meantime, the modulation circuit 10 outputs driving signals for the respective display elements (3,840 display elements) of the selected row at the same time during one selected horizontal scanning period. The driving signals are respectively supplied to the display elements through the vertical wirings 14.

Each of the display elements 13 emits light only when the above-mentioned scanning signal and driving signal are applied at the same time, but does not emit light when either one of the scanning signal and the driving signal is applied. Accordingly, the 3,840 display elements of the selected row are driven by predetermined driving signals and emit light at predetermined luminance. During the next one horizontal scanning period, the next row is selected, and 3,840 display elements of the selected row emit light at predetermined luminance in a manner similar to those of the previous row.

In this embodiment, the modulation method of images is pulse width modulation (PWM). This is intended to realize gradation representation by changing the pulse width of a voltage to be applied to each display element during one horizontal scanning period. Namely, as the gradation of image data becomes larger, the pulse width of applied voltage is made larger to cause a display element to emit brighter light. Conversely, as the grayscale of image data becomes smaller, the pulse width of applied voltage is made smaller to cause a display element to emit darker light.

Figure 2:
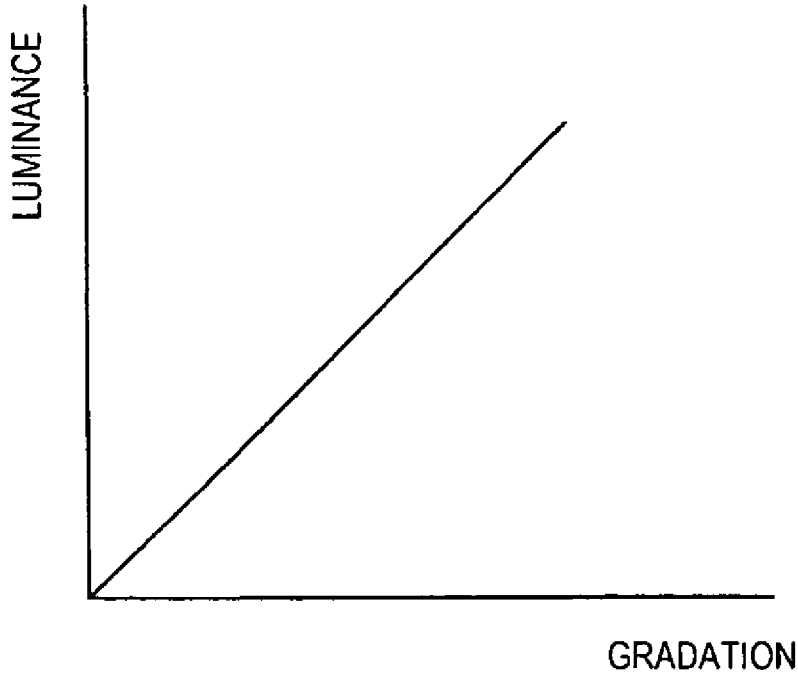
FIG. 2 is a graph showing a gradation-luminance characteristic of PWM.

A gradation-luminance characteristic due to PWM is shown in FIG. 2. As shown in FIG. 2, when PWM is performed, the gradation-luminance characteristic becomes an approximately linear characteristic. In the case of PWM, the display elements are made to emit light at predetermined luminance, and the time of emission of the display elements is modulated. However, in the technical field of display devices, even in such a case, the extent of brightness which is obtained as a result is often called luminance in consideration of the case of amplitude modulation, and such usage is also adopted in this patent application.

(Unevenness Measuring Part)

In this embodiment, on the assumption that the distribution of unevenness varies during the use of the display device 200, the display device 200 is provided with a function capable of correcting unevenness in accordance with an instruction of a user or the like. The unevenness measuring part 20 of this embodiment uses a CCD camera. The unevenness measuring part 20 receives an instruction from the correction value generating part 2, and measures the luminance of each of the display elements 13 (the luminance of each of the approximate three million display elements). During this luminance measurement, the entire surface of the display device 200 is made to emit light with the same image data, and the luminance of the entire surface is collectively measured by the unevenness measuring part 20. Otherwise, if the resolution of the CCD camera is insufficient, the display surface of the display device 200 may be divided into a plurality of areas so that the luminance can be measured a plurality of times.

Measured luminance data d20 is sent to the correction value generating part 2, and the correction value generating part 2 creates a correction value by calculation.

In this embodiment, it is assumed that the unevenness measuring part 20 measures luminance; namely, data of measured luminance is obtained as data having a correlation to luminance. However, data having a correlation to luminance does not need to be data obtained by directly measuring luminance, and may be any other kind of data that has a correlation to luminance, for example, the number of emission electrons of each display element or the amount of current flowing through each display element. Accordingly, the invention is not limited to a construction which has the unevenness measuring part 20 like a CCD camera outside the display device 200, and can also be applied to a construction in which a display device has an unevenness measuring part inside itself.

(Correction Circuit)

The correction circuit 1 will be described below. The correction circuit 1 includes the correction value generating part 2 having the operation part 4 and the table 5, the multiplier 3 which multiplies the correction value d4 outputted from the correction value generating part 2 by the image data d1, and the switch 6 which effects switching between the measuring data d6 outputted from the correction value generating part 2 and the output d5 of the multiplier 3.

The correction value d4 for correcting the luminance unevenness of the display panel 12 is stored in the table 5. In accordance with a synchronizing signal d3, the correction value d4 is read from the table 5 and outputted to the multiplier 3. The synchronizing signal d3 is the same signal as a synchronizing signal for the image data d1. Accordingly, image data of a predetermined pixel can be multiplied by a correction value corresponding to the pixel. In FIG. 1, the image data d1 is shown by one line, but actually includes 3-line data for RGB respectively. Similarly, the correction value d4 also includes 3-line data for RGB respectively.

In the multiplier 3, the respective data for RGB of the image data d1 are multiplied by the corresponding RGB correction values of the correction value d4. The multiplier 3 provides the output data d5.

Symbol d6 denotes measuring image data. In this embodiment, the measuring image data d6 is assumed to be totally-white, ½ grayscale data (for example, 128 grayscale levels, if a full grayscale is made of 255 levels).

Incidentally, the signal d6 need not necessarily be supplied from the correction value generating part 2, and may also be directly supplied to the modulation circuit 10 as measuring image data which is externally created.

The switch 6 is a switch for effecting switching between the image data d5 and d6. The switch 6 selects and outputs the image data d5 when a general television image or PC image is to be displayed. The switch 6 selects and outputs the measuring image data d6 when luminance unevenness is to be measured by the unevenness measuring part 20. This switching is performed by control signals from the correction value generating part 2.

During the display of a general television image or PC image, the correction value generating part 2 outputs the correction value d4. However, when the correction value d4 is to be updated, the correction value generating part 2 outputs the measuring image data d6 and issues a measurement instruction to the unevenness measuring part 20. Then, on the basis of the measured luminance data d20, the operation part 4 performs operation processing which will be described later, and calculates data. Then, the correction value stored in the table 5 is updated with this data.

In the above description, the unevenness measuring part 20 corresponds to index data acquiring means. The operation part 4 corresponds to an index data conversion circuit, a luminance target value spatial frequency component computation circuit, a spatial frequency component inverse-conversion circuit, and a correction value calculation circuit.

(Correction Method 1)

A first correction method according to this embodiment will be described below. In this embodiment, the luminance of a certain display element that is obtainable when luminance unevenness is eliminated by ideal correction free of correction error is called a luminance target value of the display element.

FIG. 3 shows luminance data for R (red) relative to a certain 7×7 display element area, from among the luminance data d20 measured by the unevenness measuring part 20. For the convenience of description, the luminance data are represented by values relative to 100 which is the average luminance of R on the entire screen. Similar luminance data exist as to G (green) and B (blue), but since the same processing is performed on R, G and B, the following description refers to the processing of R by way of example.

Figure 4A:
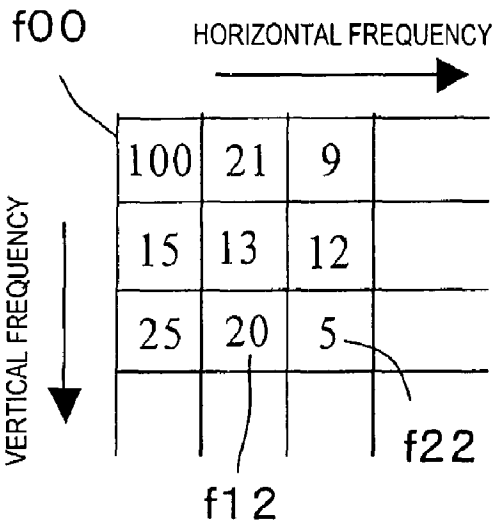
FIG. 4A is a view showing DCT conversion of the luminance distribution shown in FIG. 3.

The correction value generating part 2 first converts the input luminance data d20 into spatial frequency data by DCT (Discrete Cosine Transform) or the like. If 1,280×768 R luminance data are DCT-converted, 1,280×768 spatial frequency component data are obtained. A portion of the spatial frequency component data of the luminance data d20 is shown in FIG. 4A. In FIG. 4A, f00 represents a DC component, the horizontal direction represents horizontal frequencies, and higher-frequency components are arrayed toward the right. The vertical direction represents vertical frequencies, and higher-frequency components are arrayed toward the bottom. FIG. 4A shows that as the frequency component data value becomes larger, the luminance unevenness at the corresponding frequency becomes larger. In addition, in FIG. 4A, the DC component is normalized as 100 for way of description.

Figure 6:
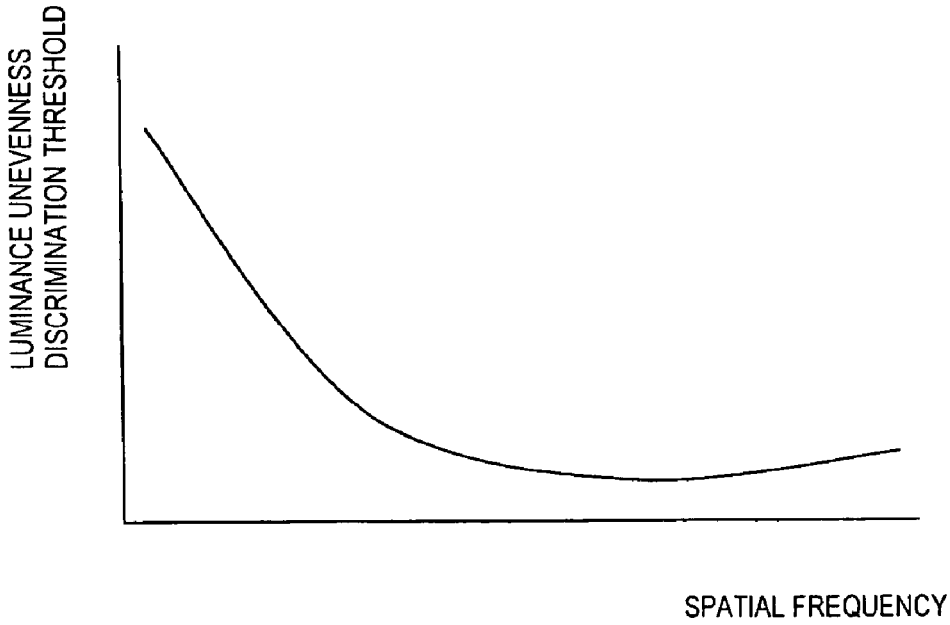
FIG. 6 is a graph representing a visual characteristic.

FIG. 6 shows the spatial frequency characteristic of the luminance unevenness discrimination threshold of a human being. As shown in FIG. 6, human visual sensation generally exhibits a larger discrimination threshold with respect to lower-frequency luminance unevenness. Namely, it can be seen that human beings have difficulty in discriminating low-frequency luminance unevenness. This embodiment restricts the frequency components of FIG. 4A in consideration of this visual characteristic.

Figure 4B:
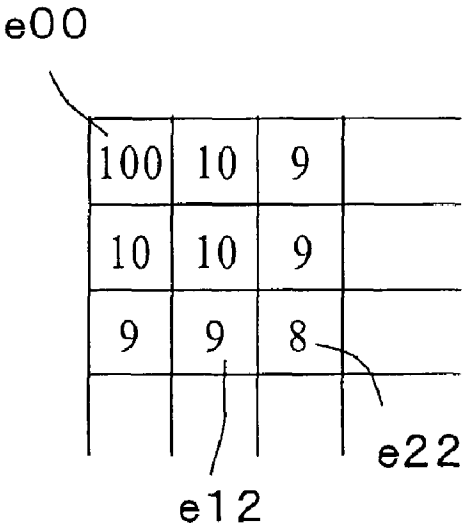
FIG. 4B is a view two-dimensionally representing a visual characteristic.

Although FIG. 6 one-dimensionally shows the visual characteristic, a two-dimensional case can also be understood similarly to the one-dimensional case. FIG. 4B shows a two-dimensionally extended view of the visual characteristic of FIG. 6, and two-dimensionally represents the frequency components of the discrimination threshold of luminance unevenness. In FIG. 4B, similarly to FIG. 4A, the horizontal direction represents horizontal frequencies, the vertical direction represents vertical frequencies, and a DC component e00 is normalized as 100. For example, in the case where the DC component is made 100, if the frequency component of e12 is not greater than 9, this indicates that the luminance unevenness at the frequency of e12 cannot be discriminated.

Figure 4C:
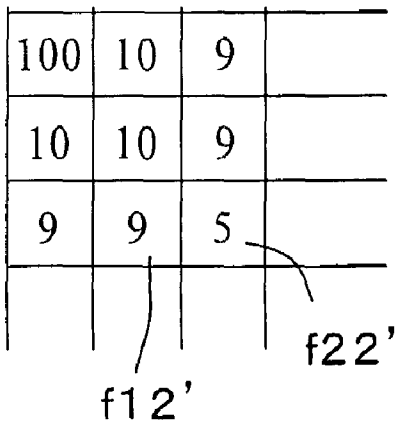
FIG. 4C is a view showing frequency components of luminance target values.

In this embodiment, the value of the luminance unevenness discrimination threshold of the frequency component of FIG. 4A and that of the corresponding frequency component of FIG. 4B are compared, and the smaller one is adopted as the frequency component of a luminance target value. The frequency components of the luminance target values obtained in this manner are shown in FIG. 4C. For example, in the case where a frequency component f12 of measured luminance data is 20, this value is compared with a value of 9 of the corresponding frequency component e12 of FIG. 4B, and the smaller one, i.e., 9, is set as a frequency component f12' of the luminance target value. In the case where a frequency component f22 of measured luminance data is 5, this value is compared with a value of 8 of the corresponding frequency component e22 of FIG. 4B, and the smaller one, i.e., 5, is set as a frequency component f22' of the luminance target value.

The luminance target values of FIG. 4C which have been obtained in this manner are comparatively large for low-frequency components and comparatively small for high-frequency components. Each frequency component of the luminance target values is not greater than the luminance unevenness discrimination threshold. The frequency components of these luminance target values are converted into luminance data (luminance target values) by inverse DCT or the like.

FIG. 5 shows the luminance target values obtained by performing the processing of this embodiment on the luminance data shown in FIG. 3. As shown in FIG. 5, the luminance target values exhibit a luminance distribution in which only low-frequency components are left.

Values obtained by dividing the luminance target values (FIG. 5) by the luminance data (FIG. 3) measured by the unevenness measuring part 20 are set as correction values. As mentioned above, in this embodiment, gradation representation is performed by PWM. As shown in FIG. 2, when PWM is performed, the gradation-luminance characteristic becomes an approximately linear characteristic, so that when a gradation value is multiplied by a predetermined coefficient C, the luminance becomes approximately C times as large. This characteristic is used to multiply image data, i.e., gradation values, by correction values, whereby luminance unevenness correction is performed.

Correction values of this embodiment are shown in FIG. 7. These correction values are obtained by dividing the luminance target values (FIG. 5) by the measured luminance data (FIG. 3). These correction values are stored in the table 5. When a general image such as a television signal is to be displayed, correction values are read from the table 5 in accordance with the synchronizing signal d3 and are outputted to the multiplier 3 as the correction value d4.

The multiplier 3 multiplies the image data d1 by the correction value d4 and outputs the image data d5 representative of corrected luminance unevenness. The switch 6 selects and outputs the image data d5 when a general image such as a television signal is to be displayed. Accordingly, the output signal d2 of the switch 6 is image data whose luminance unevenness is corrected.

CORRECTION EXAMPLE 1

Figure 8A:
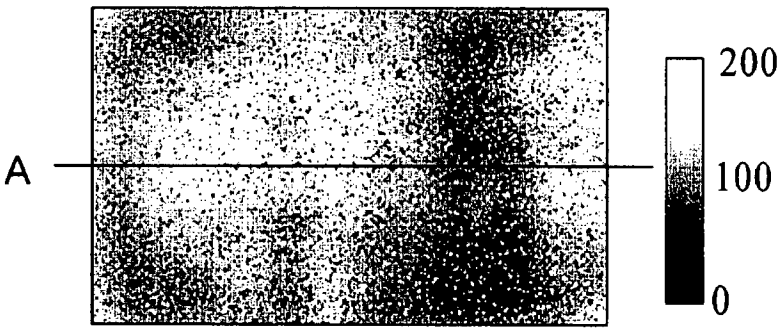
FIG. 8A shows a luminance distribution obtained when no correction is performed.
Figure 8B:
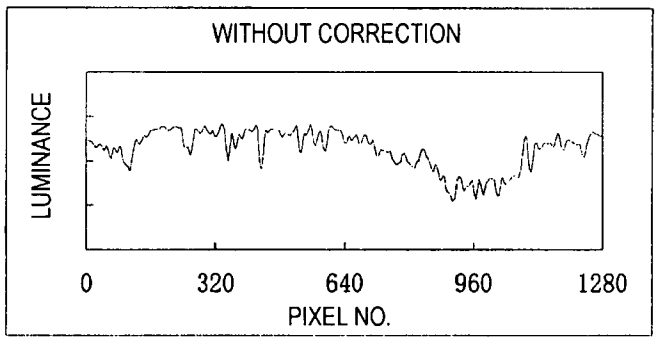
FIG. 8B shows a luminance distribution obtained along a certain row when no correction is performed.

FIGS. 8A to 8D shows an example of luminance unevenness correction by this embodiment. FIG. 8A shows a screen luminance distribution obtained when full-screen white data is displayed without the correction processing of this embodiment. FIG. 8A shows 1,280×769 luminance distribution data for R. FIG. 8B shows a luminance profile taken along a solid line A of FIG. 8A. In the case where the data is displayed without the correction processing, as shown in FIGS. 8A and 8B, both low-frequency unevenness and high-frequency unevenness are large and a problem occurs in terms of image quality.

Figure 8C:
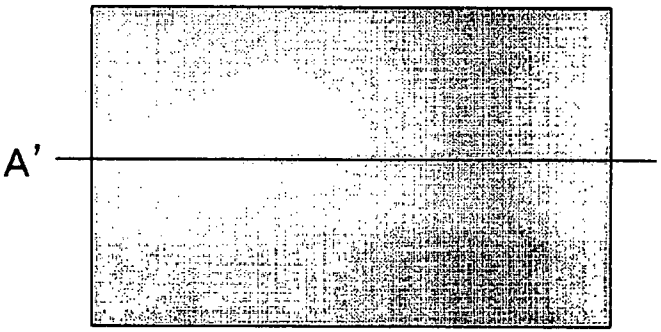
FIG. 8C shows a luminance distribution obtained when a correction is performed according to this embodiment.
Figure 8D:
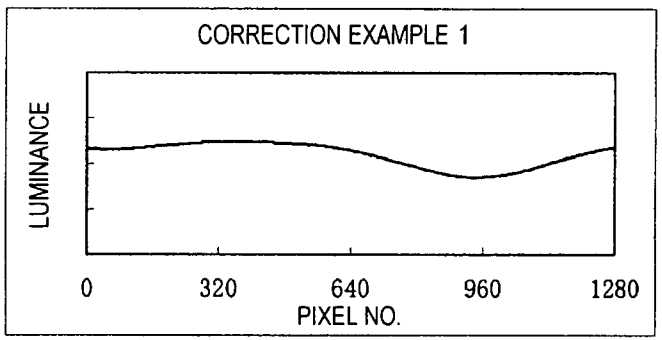
FIG. 8*d* shows a luminance distribution obtained along a certain row when a correction is performed according to this embodiment.

FIG. 8C shows a luminance distribution obtained when the correction processing of this embodiment is performed. FIG. 8D shows a luminance profile taken along a solid line A' of FIG. 8C. It can be seen that when the processing of this embodiment is performed, the high-frequency unevenness is approximately completely eliminated and the low-frequency unevenness is reduced to a negligible degree.

(Correction Method 2)

A second correction method according to this embodiment will be described below.

Similarly to the above-described correction method 1, the second correction method will be described with reference to the luminance data d20 shown in FIG. 3.

Figure 9A:
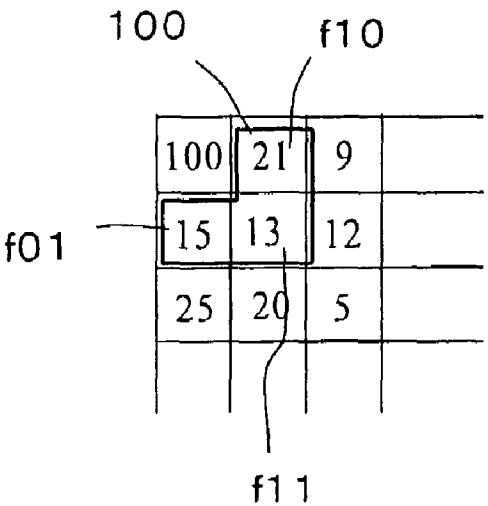
FIG. 9A is a view showing DCT conversion of the luminance distribution shown in FIG. 3.

Similarly to the correction method 1, in the correction value generating part 2, the input luminance data d20 is converted into spatial frequency data by DCT or the like. A portion of the spatial frequency component data of the luminance data d20 is shown in FIG. 9A. FIG. 9A is the same as FIG. 4A.

In this embodiment, a passage region 100 is provided as shown in FIG. 9A. The term "passage region" means a frequency range which cannot easily be detected by human eyes even if its frequency component remains. For example, in this embodiment, it is determined that luminance unevenness is difficult to detect in a frequency range whose luminance unevenness discrimination threshold is 10% or more, and the frequency range whose luminance unevenness discrimination threshold is 10% or more is determined as the passage region. In general, low-frequency components constitute the passage region. In FIG. 9A, three components f10, f01 and f11 constitute the passage region.

Figure 9B:
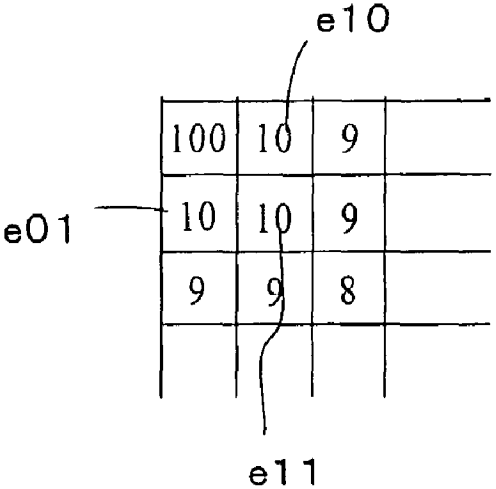
FIG. 9B is a view two-dimensionally representing a visual characteristic.

FIG. 9B shows a two-dimensionally extended view of the visual characteristic of FIG. 6, and two-dimensionally represents the frequency component of the luminance unevenness discrimination threshold. FIG. 9B is the same as FIG. 4B. In this embodiment, each of the frequency components of the passage region is multiplied by a coefficient D so that the total of the frequency components of the passage region becomes smaller than the minimum value of the luminance unevenness discrimination threshold of the passage region. Namely, in the case of FIG. 9, first, the coefficient D is found as follows:

$$D = \mathrm{Min}(e10, e01, e11)/(f10 + f01 + f11) \quad (1)$$

$$= 10/49$$

$$\cong 0.2$$

where Min( ): minimum value put in ( )

Then, the coefficient D is multiplied by each of the frequency components of the passage region to find the frequency components of luminance target values.

$$f10''=Int(D\times f10)=4 \quad (2)$$

$$f01''=Int(D\times f01)=3 \quad (3)$$

$$f11''=Int(D\times f11)=2 \quad (4)$$

where Int( ): omission of the decimal part of a value found in ( ). The frequency components of all regions except the passage region are assumed to be 0s.

Figure 9C:
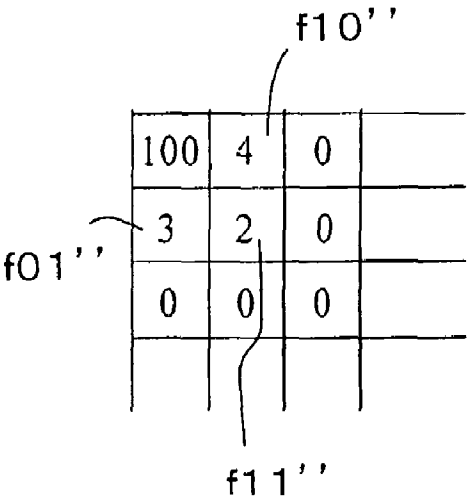
FIG. 9C is a view showing frequency components of luminance target values.

The frequency components of the luminance target values found in this manner are shown in FIG. 9C. In this embodiment, the frequency components of the luminance target values remain in only the passage region, and the regions except the passage region have 0s. The frequency components of these luminance target values are converted into luminance data (luminance target values) by inverse DCT or the like.

The total of the frequency components of the luminance target values found in this embodiment is smaller than the minimum value of the luminance unevenness discrimination threshold of the passage region, whereby it is possible to realize correction of higher uniformity than correction using the correction method 1.

The luminance target values found by performing the processing of this embodiment on the luminance data shown in FIG. 3 are shown in FIG. 10. Since the luminance target values found by this embodiment only contain slight low-frequency components, all the luminance target values are 100 in a narrow region of 7×7 as shown in FIG. 10.

The luminance target values (FIG. 10) are divided by the measured luminance data (FIG. 3), whereby correction values are obtained. As described above, in this embodiment, gradation representation is performed by PWM. As shown in FIG. 2, when PWM is performed, the gradation-luminance characteristic becomes an approximately linear characteristic, so that in the case where a gradation value is multiplied by the predetermined coefficient C, the luminance also becomes approximately C times as large. This characteristic is used to perform luminance unevenness correction by multiplying image data, i.e., gradation values, by correction values.

The correction values of this embodiment are shown in FIG. 11. These correction values are obtained by dividing the luminance target values (FIG. 10) by the measured luminance data (FIG. 3). These correction values are stored in the table 5. When a general image such as a television signal is to be displayed, the correction values are read from the table 5 in accordance with the synchronizing signal d3, and are outputted to the multiplier 3 as the correction value d4.

In the multiplier 3, the image data d1 is multiplied by the correction value d4 and is outputted as the image data d5 which is corrected for luminance unevenness. The switch 6 selects and outputs the image data d5 when a general image such as a television signal is to be displayed. Accordingly, the output signal d2 of the switch 6 is image data which is corrected for luminance unevenness.

CORRECTION EXAMPLE 2

Figure 12A:
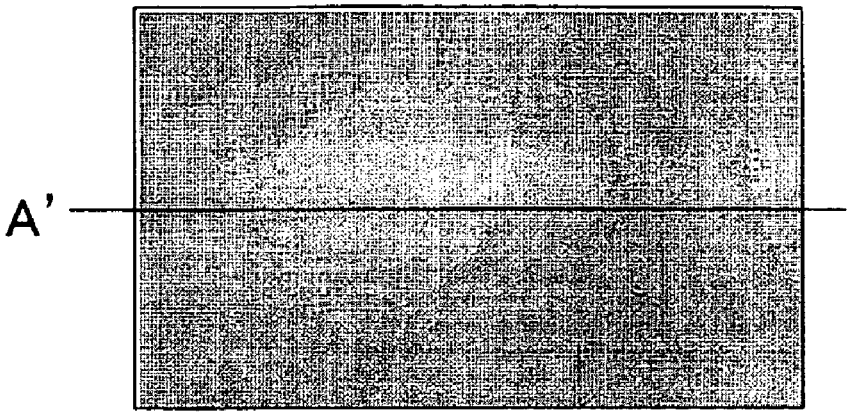
FIG. 12A shows a luminance distribution obtained when a correction is performed according to this embodiment.
Figure 12B:
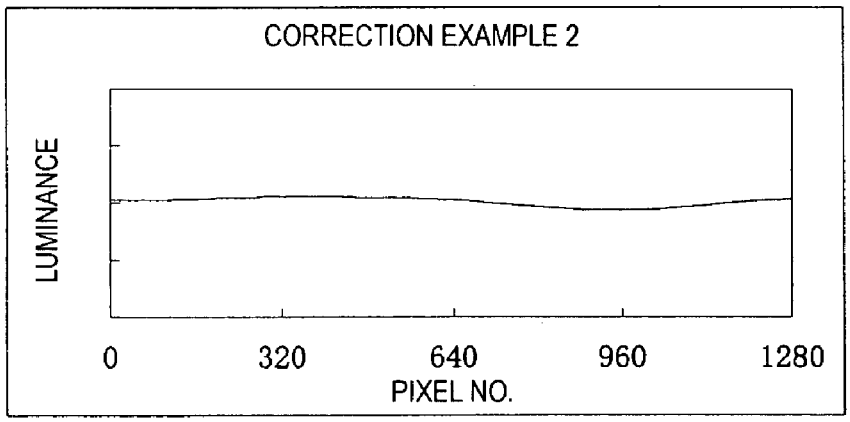
FIG. 12B shows a luminance distribution obtained along a certain row when a correction is performed according to this embodiment.

A luminance unevenness correction example 2 of this embodiment is shown in FIG. 12. The luminance distribution obtained when image data is displayed without correction is shown in FIG. 8A. FIG. 12B shows a luminance profile taken along a solid line A' of FIG. 12A. It can be seen that when the processing of this embodiment is performed, the high-frequency unevenness is completely eliminated and the low-frequency unevenness is reduced to an undetectable degree.

According to the above-described correction method 1, it is possible to display an image in which high-frequency unevenness is restrained to a great extent in consideration of the visual characteristics of human beings. Since low-frequency unevenness cannot easily be detected for human sensations, low-frequency unevenness remains in an amount greater than high-frequency unevenness, but in a negligible amount. In addition, according to the correction method 2, it is possible to display an image in which high-frequency unevenness is completely eliminated and low-frequency unevenness is reduced to an undetectable degree.

According to this embodiment, since low-frequency unevenness remains unlike the case where luminance target values are made uniform on the entire screen, it is possible to reduce the amount of luminance correction and improve correction accuracy. In addition, unlike the method of restraining a particular frequency component by means of a single filter, since this embodiment reduces only the necessary frequency components, there is no problem that low-frequency unevenness easily remains or luminance target values approach uniformity.

Figure 13:
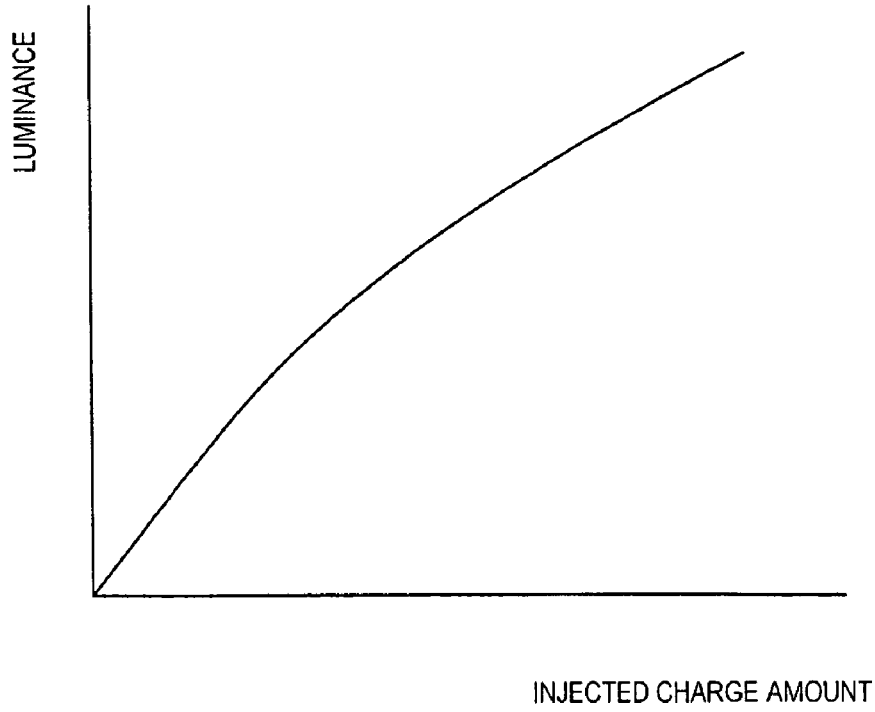
FIG. 13 is a view aiding in describing a saturation characteristic of a phosphor.

In the case where phosphors are used as display elements like this embodiment, the luminescent characteristics of each of the phosphors have a saturation characteristic as shown in FIG. 13. As shown in FIG. 13, the phosphor has a luminescent characteristic which is saturated with respect to an injected charge amount, and even in the case where modulation is performed with PWM, the gradation luminance characteristic does not become completely linear. Accordingly, as the amount of correction becomes larger, the influence of the saturation characteristic of the phosphor becomes larger, and correction accuracy becomes lower.

Figure 14:
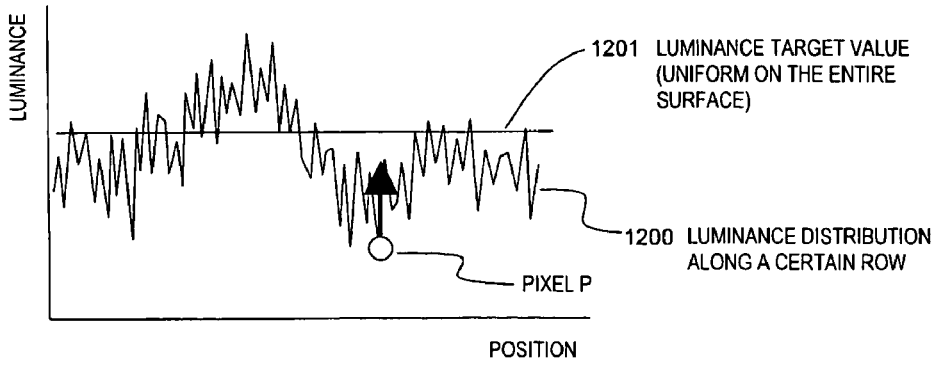
FIG. 14 is a view aiding in describing a problem occurring when a target luminance is made uniform.

In the case where the gradation in a pixel darker than a luminance target value is to be increased by correction, the gradation of low gradation image data can be increased, but in the case of high gradation image data, there is a case where even if its gradation is increased to a full gradation (for example, 255 levels), the full gradation does not reach the luminance target value. FIG. 14 is a view aiding in describing this problem. The horizontal axis of FIG. 14 represents horizontal positions on a certain row of the display device, while the vertical axis of FIG. 14 represents luminance. Reference numeral 200 denotes a luminance distribution along a circuit row, and reference numeral 201 denotes a luminance target value. The luminance target value is uniform on the entire screen. A certain pixel P is darker than the luminance target value. If the image data of the pixel P is low gradation data, the luminance target value can be displayed by correction which increases the display gradation of the pixel P, whereas if the image data of the pixel P is high gradation data, the luminance target value cannot be reached even if the display gradation of the pixel P is increased to a full gradation (for example, 255 levels). Accordingly, in the case of high gradation image data, correction error increases.

According to the correction methods 1 and 2 described in this embodiment, since the amount of correction can be restrained, correction accuracy does not lower even in a display device using phosphors as its display elements. In addition, since luminance target values are not uniform on the entire screen, correction accuracy does not lower with respect to high gradation image data.

REFERENCE EXAMPLE

The above description has referred to a construction which performs correction when driving for displaying is to be performed, but in a case which uses a display element having an adjustable display characteristic relative to input signals, the above-described construction for setting luminance target values can be used as a construction which sets a target value for adjusting the display characteristic. This characteristic adjustment is performed before driving for displaying is actually performed. For example, in the case where an electron emitting device is used as a display element, the relationship between a voltage to be applied to the electron emitting device and an emission current amount can be adjust by voltage application. This adjustment method is described in United States Patent Application 20020122018 (United States Patent application corresponding to JP-A-2003-123650). The luminance target value described hereinabove can be used as a target value for characteristic adjustment in United States Patent Application 20020122018.

As is apparent from the foregoing description, according to the invention, it is possible to realize a display device capable of providing suitable display while restraining a correction amount.

What is claimed is:

1. A method of determining correction values for driving a plurality of display elements for displaying an image, comprising:

a step of acquiring data having a correlation to luminance by driving a display element in accordance with image data for measuring;

a step of performing conversion of the acquired data having the correlation to luminance into spatial frequency data comprising low-frequency components in a passage region and high-frequency components out of the passage region, wherein the passage region is a low-frequency range in which it is difficult for human eyes to discriminate luminance unevenness;

a step of acquiring spatial frequency components of luminance target values, by reducing low-frequency components of the spatial frequency data and setting the high-frequency components of the spatial frequency data to 0;

a step of acquiring luminance target values by performing an inverse conversion of the conversion on the spatial frequency components of the luminance target values; and a step of calculating a correction value for driving the display element, on the basis of the luminance target value.

2. A method of determining the correction values according to claim 1, wherein the step of acquiring the spatial frequency component of the luminance target value comprises a step of multiplying each of the spatial frequency components in the passage region by a coefficient which is smaller than a value obtained by dividing a minimum value of the luminance unevenness discrimination threshold in the passage region by a total of the spatial frequency components in the passage region.

3. A method of determining the correction values according to claim 1, wherein the step of calculating the correction value comprises a step of dividing the luminance target value by the acquired data having the correlation to luminance.

4. A method of manufacturing a display device, comprising:

a step of preparing a display device provided with a plurality of display elements and storage means for storing correction values for performing correction on input signals to the respective display elements; and a step of storing into the storage means correction values determined by a method of determining correction values according to claim 1.

* * * * *